United States Patent [19]

Harken et al.

[11] Patent Number: 4,719,869

[45] Date of Patent: Jan. 19, 1988

[54] SAILBOAT TRAVELER CAR ASSEMBLY WITH REMOVABLE BLOCK

[75] Inventors: Peter O. Harken, Pewaukee, Wis.; Robert A. Whitehouse, Newport, R.I.; Kenneth E. Lange, West Allis, Wis.

[73] Assignee: Vanguard, Inc., Pewaukee, Wis.

[21] Appl. No.: 927,518

[22] Filed: Nov. 6, 1986

[51] Int. Cl.[4] ..... B63H 9/10

[52] U.S. Cl. ..... 114/102; 114/204

[58] Field of Search ..... 114/39, 102, 103, 104, 114/105, 106, 107, 108, 109, 111, 112, 113, 114, 115, 204, 205

[56] References Cited

U.S. PATENT DOCUMENTS

| | | | |
|---|---|---|---|
| 3,678,876 | 7/1972 | Alter | 114/102 |
| 3,978,809 | 9/1976 | Snyder | 114/204 |
| 3,985,092 | 10/1976 | Robbins | 114/204 |
| 4,147,121 | 4/1979 | Fogh et al. | 114/204 |
| 4,502,406 | 3/1985 | Merry | 114/112 |
| 4,651,668 | 3/1987 | Melrose | 114/204 |

FOREIGN PATENT DOCUMENTS

| | | | |
|---|---|---|---|
| 2373716 | 8/1978 | France | 114/112 |

*Primary Examiner*—Joseph F. Peters, Jr.
*Assistant Examiner*—Stephen P. Avila
*Attorney, Agent, or Firm*—Juettner Pyle Lloyd & Verbeck

[57] ABSTRACT

An adjustable system is described for control of a genoa sheet on a sailboat. The sheet is passed through a pulley or lead block carried by a car which is slidably mounted on a track. The block and car have complementary interfitting parts to enable the block to be removed from one car and secured to another car on a second track.

21 Claims, 11 Drawing Figures

SAILBOAT TRAVELER CAR ASSEMBLY WITH REMOVABLE BLOCK

BACKGROUND OF THE INVENTION

The equipment employed to adjust sails and rigging on modern sailing yachts has become increasingly sophisticated. In general, pulleys or bearing blocks are used in a variety of locations to provide a mechanical advantage on various control lines or sheets.

Most sailboats have a foresail called a genoa which is generally triangular in shape and has the leading edge or luff attached to the forestay, with the leading lower corner or tack attached to the deck at the bow of the boat. The fullness and shape of the sail is adjusted by a line or sheet secured to the free corner or clew of the sail. The sheet is passed through a pulley or so-called 'lead block' secured to the deck on each side of the boat, and the sheet is routed aft to a winch near the cockpit of the boat, by which the sheet may be hauled in and released. In most cases, the lead block is mounted on a track extending in a fore and aft direction, which allows the angle between the clew of the sail and the lead block to be adjusted. Also, an adjustment along the track may be made to accommodate various sizes of sails.

Particularly in the case of larger sailboats, it is now common to provide one or more pairs of side-by-side tracks on both the port and starboard side of the boat. Each of these tracks carries a genoa lead block which may be adjustably positioned along the length of the track. A separate control line or sheet is passed through each block, and one of the control lines is attached to the genoa. This arrangement allows for a greater degree of adjustment of the sail. For example, the inner track might be used for beating or sailing close to the wind, in order to provide a flatter and more efficient sail shape and profile, or optimum tacking angle. The outer track might be used when sailing off the wind, or reaching. Separate tracks may also be spaced in a fore-and-aft direction.

In the arrangement described above, at least four separate sheeting systems are required, two on each side of the boat, and each includes a separate track, block and line. In order to change from an inner to outer track and vice versa, the boat is placed on the opposite track to relieve tension on the working sheet on one side, and then the leading edge of the sheet is detached from the sail and is replaced by the other.

From the foregoing, it may be seen that the use of pairs of tracks for genoa lead cars are the cause of a great deal of clutter and confusion on the deck. Particularly with larger yachts, the lead blocks must be extremely strong and securely mounted against upward and rearward forces due to the very high loads encountered. Under sailing conditions, the extra and unused parts tend to foul lines or cause mishaps.

Another general consideration applicable to genoa lead blocks is the amount and height of the fittings or hardware projecting upwardly from the deck. It is desirable to maintain a low profile with such equipment for two reasons. First, the cut or shape of many geonas is such that the foot of the sail and the clew extends close to the deck surface, and the sheave of the block should be located close to the deck as possible. Second, racing sailboats wish to minimize windage or air friction against fittings in order to increase the maximum speed of the boat.

In the prior art, it is known to provide a pulley having a shackle or loop at the foot of the block. The shackle is retained by a pin or by a spring loaded latch to enable removal of the pulley. The detaching means available available in the prior art are not, however, suitable for genoa lead cars because they have a high profile and do not provide adequate strength without unacceptable bulk. Also, attachment of a block at a single location on a traveler car may cause the car to bind on the track.

SUMMARY OF THE INVENTION

In accordance with the present invention, a genoa lead car and track arrangement is provided and comprises a pair of spaced tracks each having a car slidably mounted thereon. A bearing block or pulley is securely mounted on one of the tracks. The base of the block is specially designed to allow quick removal of the block from one car and securement to the other car. This allows for the use of only one genoa control line or sheet on each side of the boat and also requires the use of only a single block, which may be moved from one track to another, depending on sailing conditions.

An important aspect of the present invention is to provide a method of attachment in which the load is carried over a large area whereby the bearing block does not fail or accidentally detach from the traveler car when considerable forces are transmitted to the genoa sheet. The attachment means is preferably in the form of an elongated part extending from the base of the block, which engages in a groove or a projecting lug, in an upper portion of the car.

Another important aspect is to provide a genoa lead block system with a traveler car in which the profile is as low as possible. This is accomplished by providing a recess in the traveler car and providing the base of the block with a part which engages in or interfits with the recess in an overlapping or complementary manner, thereby reducing windage and clutter on the deck.

THE DRAWINGS

DESCRIPTION OF THE PREFERRED EMBODIMENTS

Figure 1:
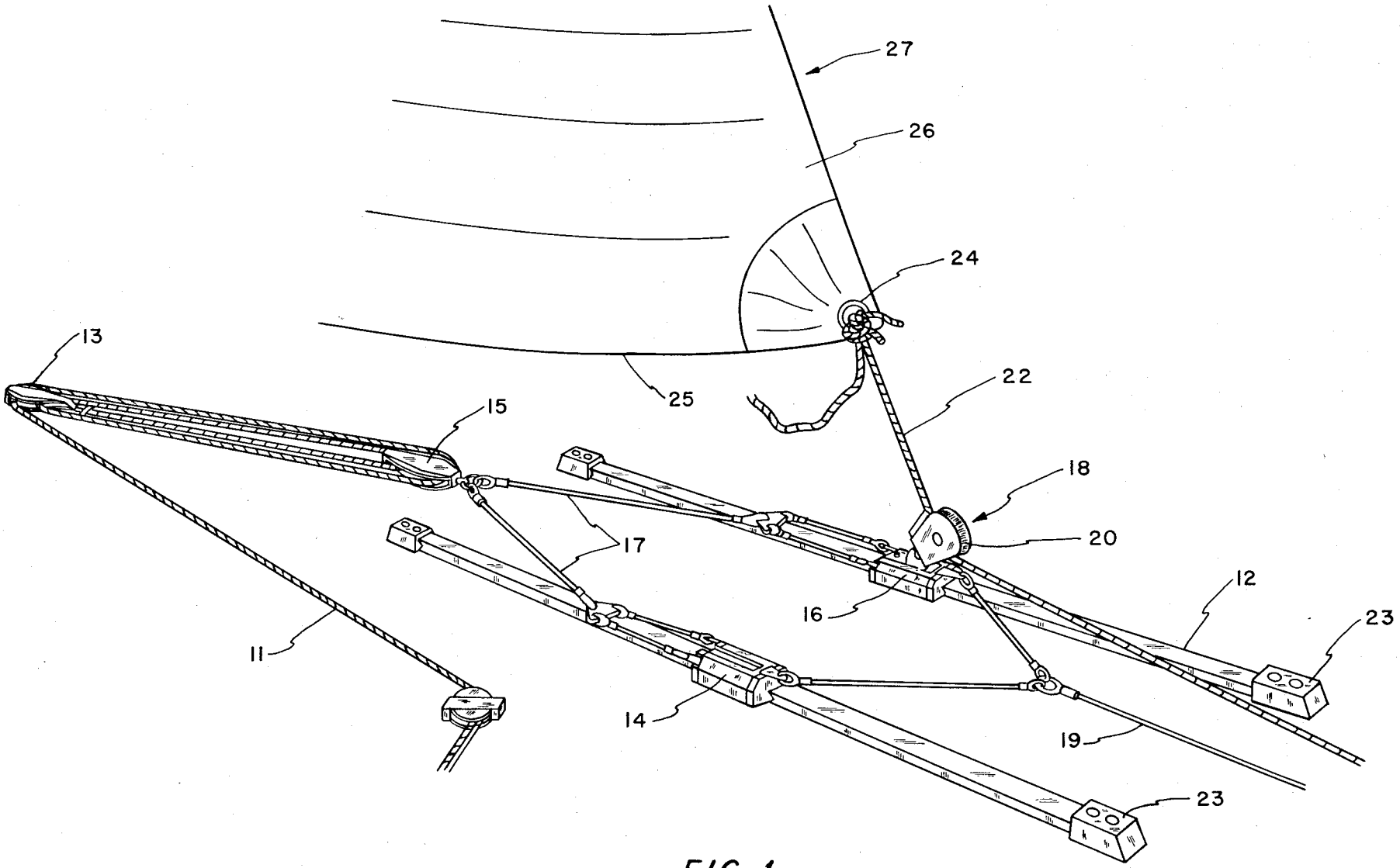
FIG. 1 is a perspective view of a two track genoa lead car system which utilizes the teachings of the present invention.

FIG. 1 illustrates a typical genoa lead car and track assembly. As shown, an inboard track 10 and an outboard track 12 are spaced from one another and are secured to the deck of the boat near the outer rail. Only the starboard side of the arrangement is shown, and an identical arrangement is provided at the other side of the boat. The tracks are arranged generally in the fore and aft direction and extend generally in parallel, although they may be disposed at an angle to each other and need not be coextensive. Also, more than two tracks may be employed. The tracks are normally positioned forward of the center of the boat for adjustment of the genoa sail.

Traveler cars 14 and 16 slidably mounted on the respective tracks 10 and 12. The track and car is constructed so as to allow lengthwise movement of the car on the track, but to prevent upward movement of the car away from the track. Typically, bearings (not shown) are provided between car and the track to reduce sliding friction.

A pulley or bearing block 18 is mounted on one of the cars, which in the example shown, is the outer car 16. As will be described herein more detail, the upper portion of the bearing block is conventional in nature and includes a grooved rotatable sheave 20, which receives the control line or sheet 22 having an end attached to the clew 24 of the genoa sail 26. The other end of sheet 22 extends toward the cockpit of the boat where it is normally wrapped around a winch, in order to enable the sheet to be hauled in and released, thereby to control the shape of the genoa sail.

As will be described herein in detail, means are provided for quickly detaching the block 18 from the one car 16 so that is can be moved over to a second car 14 and reconnected. To accomplish the required support, the base of the block 18 and the upper portion of the car 16 are provided with interfitting parts which provide support against upward pulling forces over a relatively large area.

In order to change the block from one car to another, it is necessary to first release tension on the sheet 22, which happens, for example, when the boat is on the opposite tack.

Previously, it was considered necessary to have a block mounted on each of the tracks together with a pair of control lines. The system of the present invention therefore allows elimination of one block and a control line, and reduces clutter on the deck.

Also, as shown in FIG. 1, means may be provided to position the cars 14 and 16 at any position along the track. As shown, such system may include a control line 11 connected to a block and tackle arrangement such as blocks 13 and 15, which are in turn connected by a V-shaped line 17 to the forward side of the cars 14 and 16. The aft side of the cars may be connected to an elastic line or shock cord 19. Thus, the cars may be pulled together in a forward direction by hauling on the control line. The limits of the track are defined by resilient bumpers 23 located at the ends of the track.

To achieve optimum performance in the genoa, the lead block 18 is adjusted on the track 12 to attain approximate equal loads in the foot 25 and the leach 27 of the sail. The position of the block 18 will vary with different sizes of the sails and various sailing angles.

Also, as will be described herein more detail, the block 18 has a special base portion which slidably interfits and locks into a groove on the car. When tension is removed from the genoa sheet 22, the block 18 may be removed from the car 16 by sliding the block forwardly, and the block may then be attached to the other car 14.

Figure 2:
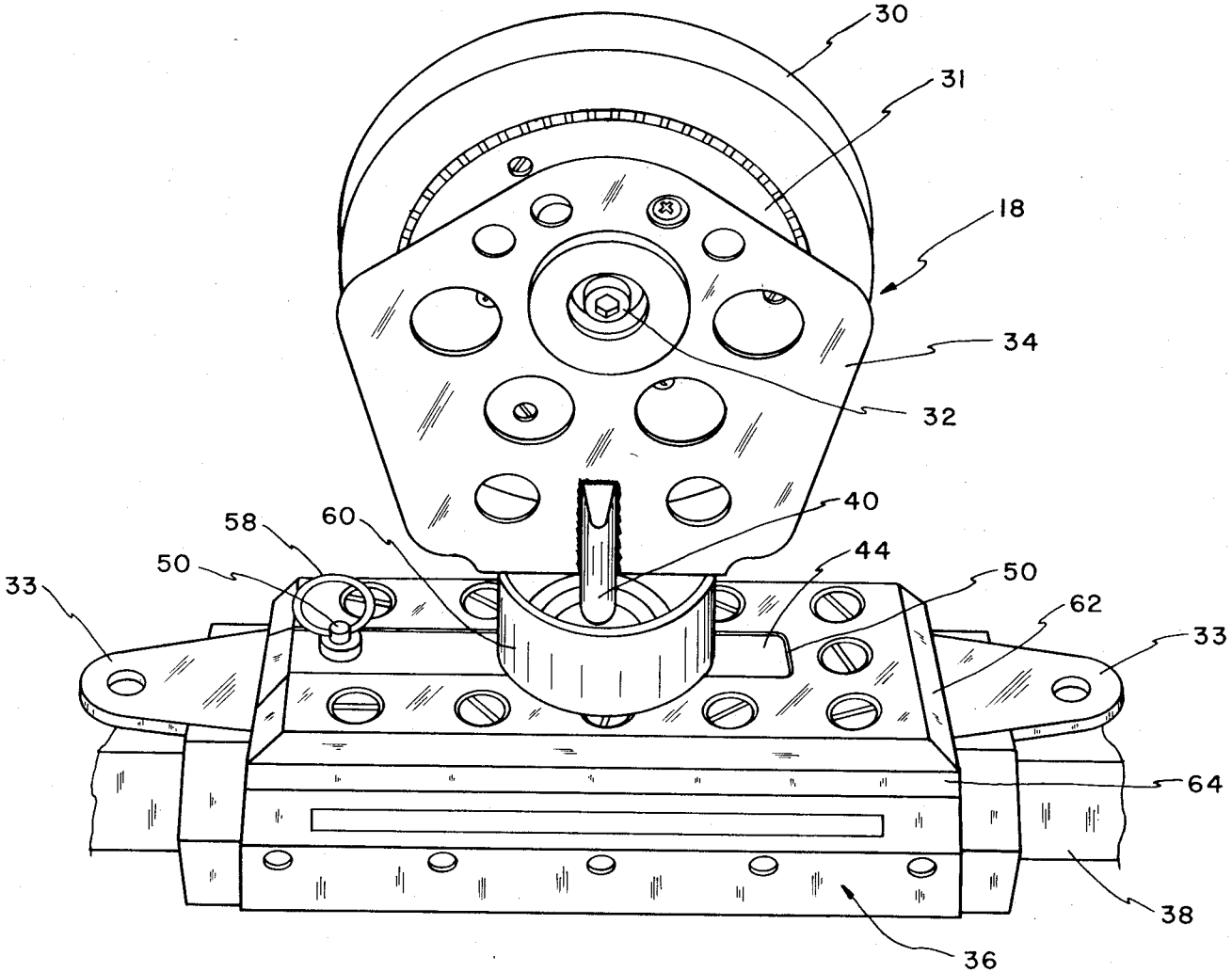
FIG. 2 is a perspective view of a bearing block which is detachably secured to a traveler car in accordance with the present invention.

FIG. 2 illustrates one of the preferred arrangements by which the block is removably secured to a traveler car. The upper portion of the pulley or block is conventional and comprises a grooved sheave 30 rotatably mounted around an axis 32 between a pair of spaced side plates 34. The block is removably attached to a traveler car 36, which rides on a track 38 secured to the deck. Preferably, the sheave 30 of the block rotates around an inner race 31 wherein the sheave and inner race are separated by bearings (not shown).

The traveler car 36 preferably includes an apertured tang 33 extending from each end of the car to enable the attachment of control lines, as described in connection with FIG. 1. These tangs preferably extend horizontally outwardly from the forward and aft ends of the car to maintain a low profile and to allow controlled adjustment of the car along the track.

Figure 3:
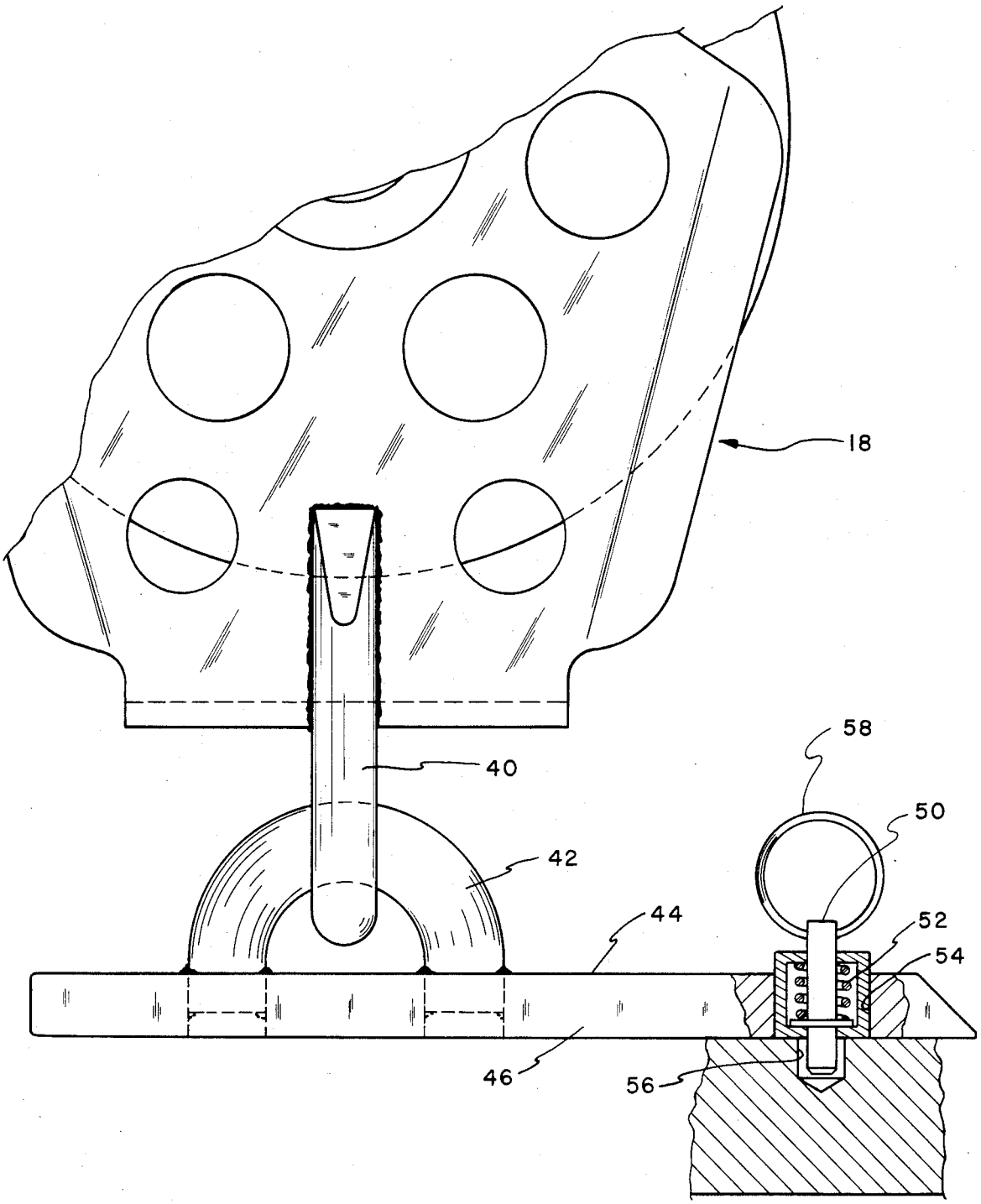
FIGS. 3 and 4 are side and end views, respectively, of the bearing block and associated parts shown in FIG. 2, with parts of the apparatus being shown in cross section.
Figure 4:
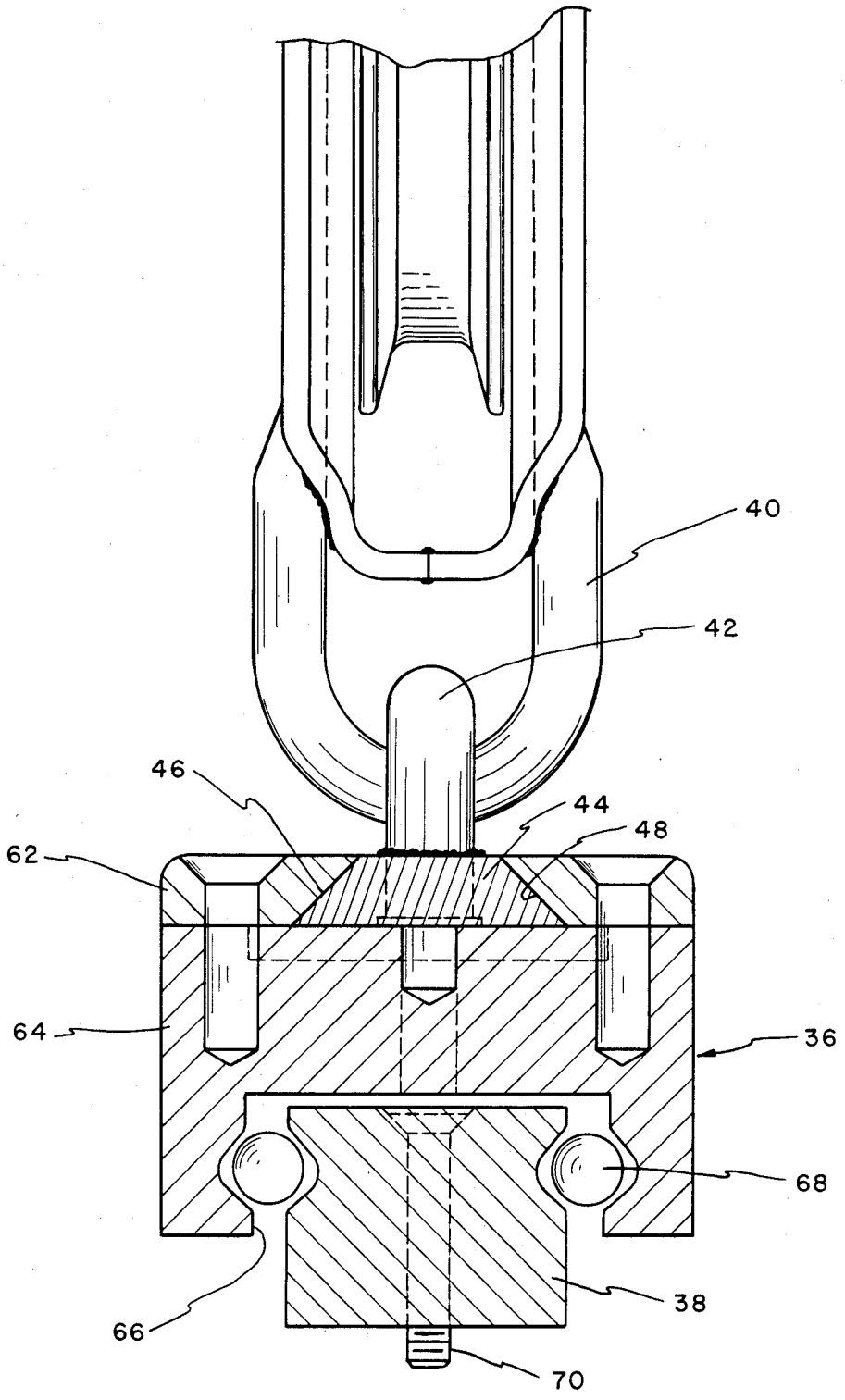

With reference now to FIGS. 2, 3 and 4, it may be seen that the base of the block comprises a continuous U-shaped hoop 40 having its legs permanently secured to the side plates 34 of the block, such as by welding or the like. The hoop 40 is engaged around a continuous U-shaped eye 42 having the legs thereof spaced in the fore and aft direction, i.e., the direction of the track 38. The legs of the eye 42 are permanently secured to a base support in the form of an elongated dovetail slider or shoe 44. As best shown in FIG. 4, the shoe has parallel top and bottom surfaces and side surfaces 46 which are inclined outwardly from top to bottom.

The car 36 has an upper portion having an upwardly open slot 48 with sloping side walls which match the cross sectional shape of the shoe 44. As shown in FIG. 2, the slot 48 is open at one longitudinal end to allow insertion and removal of the shoe 44 from one end, with the eye 42 extending through the upper slot 48. The other end of the slot is closed to provide an abutment surface 50, in order to limit inward movement of the shoe relative to the car. It will be appreciated that the shear forces exerted on the block are in the rear or aft direction, or toward the right side of the apparatus shown in FIG. 2 and toward the abutment surface.

It will be seen in FIGS. 2, 3 and 4 that the mating parts between the bearing block and the car 36 support the block against upward movement. Also, these mating parts extend for more than one half of the length of the traveler car body, to ensure that the forces from the block to the car are uniformly distributed.

Means are provided to releasably retain the shoe 44 in its inserted or engaged position in the slot 48. A vertical plunger 50, loaded by a spring 52 in a downward direction, is mounted in an aperture 54 through the shoe 44 near the forward end thereof. The lower end of the plunger 50 extends beyond the lower wall of the shoe and engages in a hole 56 located in the base of the slot 48, as shown in FIG. 3. The upper end of plunger 50 may be connected to a handle means such as the illustrated ring 58, which enables the plunger to be pulled upward and out of engagement with the hole 56. The block 18 and its associated shoe 44 may then be disengaged from the car 36 by moving the shoe forwardly away from the abutment 50 and out of engagement with the slot 48.

It may be seen that the block 18 is pivotally or universally mounted with respect to the shoe 44 by means of the engaging loops 40 and 42, which allow limited movement of the block 13 relative to the car 36 and track 38. Also, it will be noted that the loops are permanently secured to the block and shoe, respectively, and the block cannot be detached from the integral shoe. This differs from prior art teachings in which the pivotal connection would normally comprise a removable pin and would decrease the potential strength of the system.

In addition, as shown in FIG. 2, means are provided for resiliently holding the block 18 in an upright position, such as a cylindrical section of reinforced elastomer tubing 60 disposed between the base of the block and the car. This prevents the block from flopping about when not in use and makes the system easier to operate.

As shown in FIG. 4, the car 36 may comprise an upper portion 62 secured to a lower portion 64 by means of bolts as shown, with the slot 48 being formed in the upper portion to facilitate fabrication. The lower portion 64 is conventional in nature and has a downwardly facing groove 66 overlapping the sides of the track 38 and having a number of recirculating ball bearings 68 between the sides of the groove and side grooves in the track. The track 38 is permanently secured to the deck by means of a plurality of bolts 70.

Figure 5:
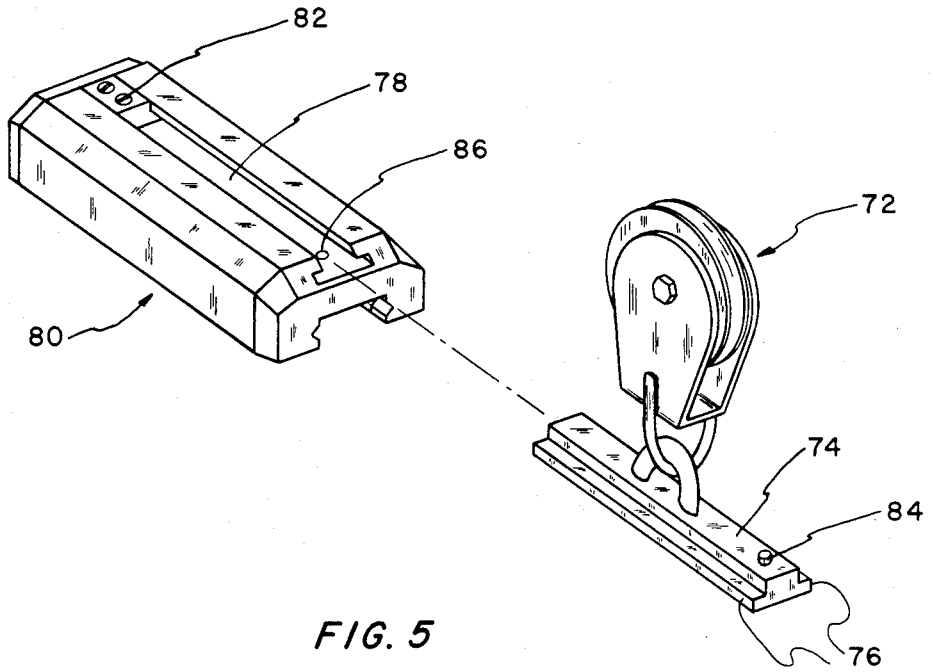
FIGS. 5 and 6 are perspective assembly views of other versions of bearing block and traveler car assemblies.
Figure 6:
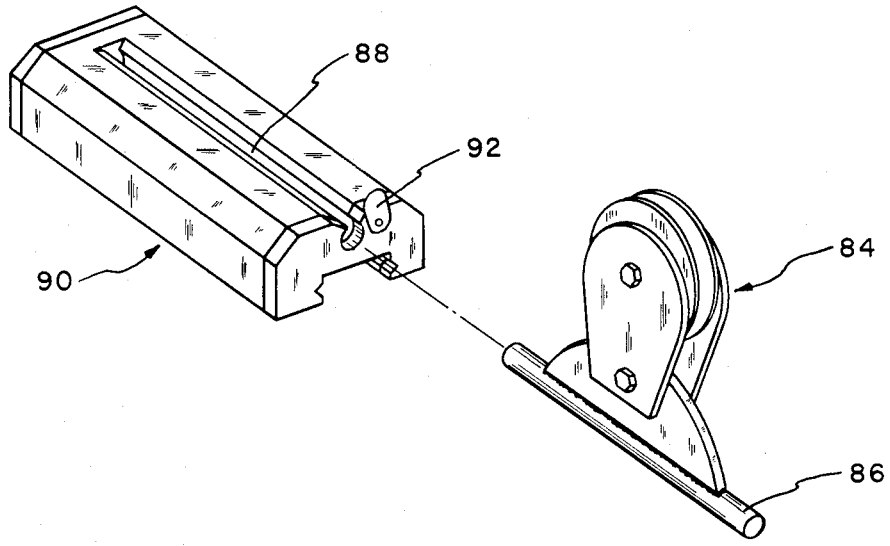

FIGS. 5 and 6 show arrangements similar to that shown in FIGS. 2–4 with the exception of the shape of the shoe and complementary receiving slot. In FIG. 5, the block 72 is pivotally and nonremovably mounted to the central portion of a shoe 74 as aforesaid. In this embodiment, the shoe is in the form of an inverted T in cross section, with lower ribs 76 projecting outwardly along the length of the shoe. The slot 78 in the traveler car 80 is also of inverted T shape to slidably receive the length of the shoe 74, together with a stop 82 at one end of the slot. The shoe may also have a plunger 84 engageable with a corresponding hole 88 in the base of the slot 78.

In FIG. 6, the base of the block 84 extending from the side plates is rigidly secured to a shoe 86, which is in the form of a cylindrical rod, and a semi-circular slot 88 is provided along the length of the car 90. The slot 88 is open upwardly for connection with the block and is open at the rear end to receive the shoe 86. It may be seem that the width of the slot at the upwardly open portion is substantially narrower than the diameter of the shoe 86 to prevent upper movement. At the same time, the shoe 86 may pivot in the slot around its axis to a limited degree to allow limited tilting of the block 84 to either side. In the embodiment shown, a latch 92 is provided on the car at the open end of the slot 88 and may be moved to cover or uncover the open end, thus retaining the shoe.

Figure 7:
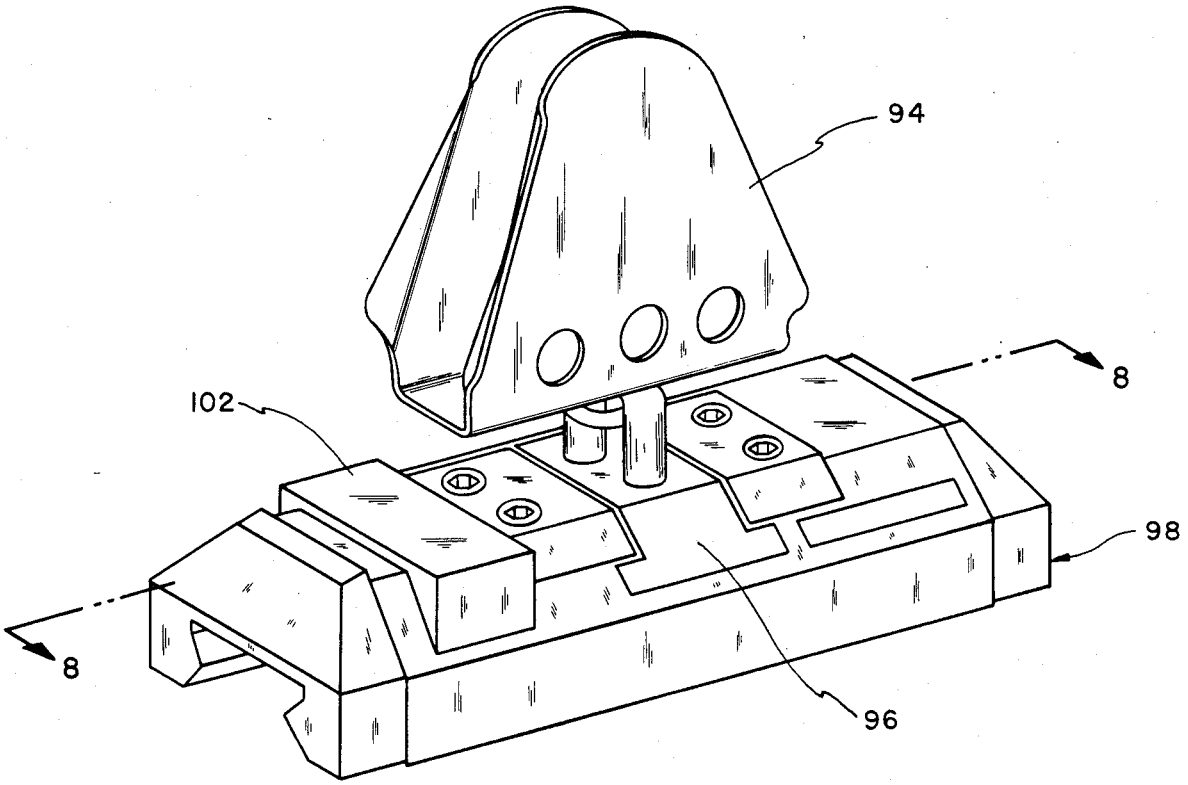
FIG. 7 is a perspective view of yet another bearing block and traveler car assembly.
Figure 8:
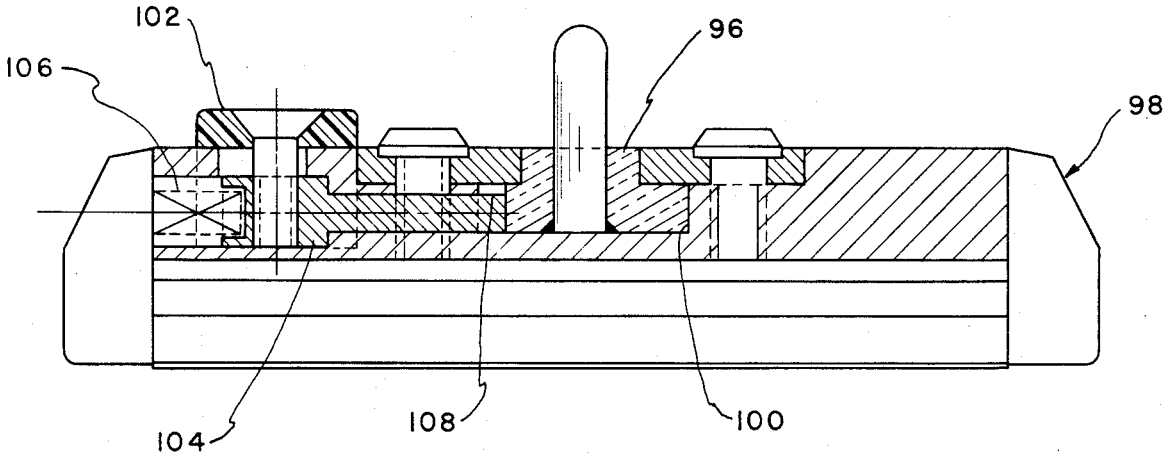
FIG. 8 is a vertical sectional view of the device shown in FIG. 10, taken along line 8—8 of FIG. 7.

FIGS. 7 and 8 show another version in which the shoe is inserted and removed transversely rather than longitudinally. Also, in this verstion, the latching mechanism is built into the traveler car. As shown, a block 94 is connected to a shoe 96 having a wedge shape in cross section, or one of the other configurations as previously described. The traveler car 98 has a matching slot 100 for receiving the shoe 98 and is open at both sides to allow removal or insertion of the shoe of the block assembly from either side. The retaining means in this embodiment comprise a handle or knob 102 which is slidably mounted on the top of the car 98. The handle 102 is operatively connected to a plunger 104 slidably mounted within the car body and urged to a closed position by a spring 106. The end of the plunger 104 is engageable with a corresponding opening 108 in one side of the shoe 96 when the shoe is centered in the slot. The handle 102 is simply pushed away from the shoe to allow removal of the block and shoe assembly to either side of the car.

Figure 9:
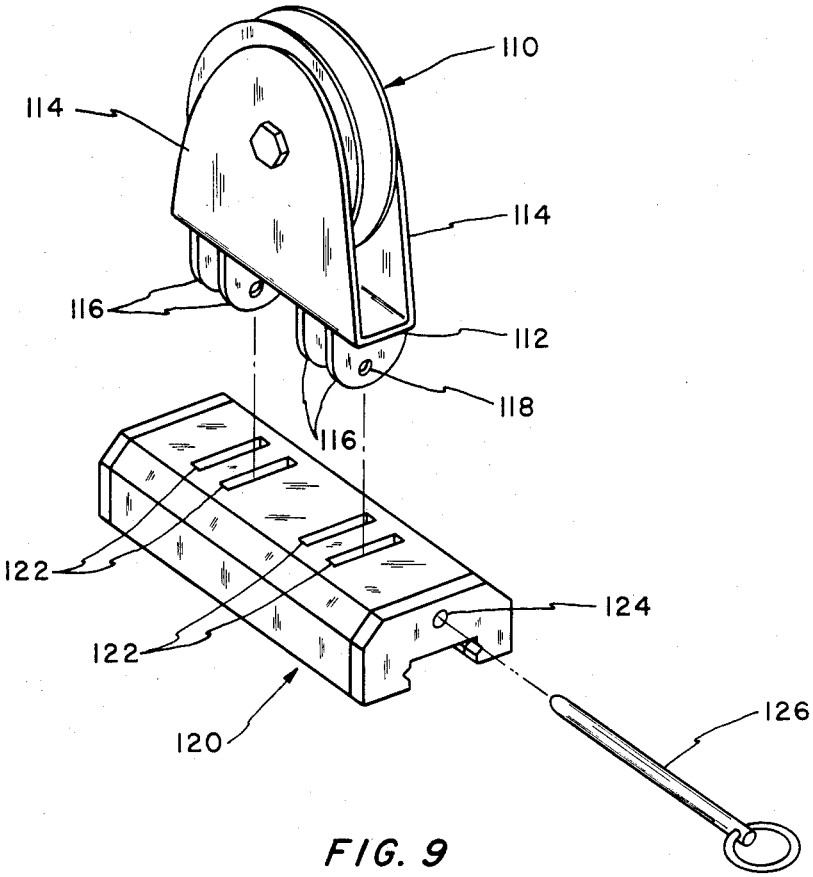
FIGS. 9 and 10 are perspective assembly views of additional embodiments.
Figure 10:
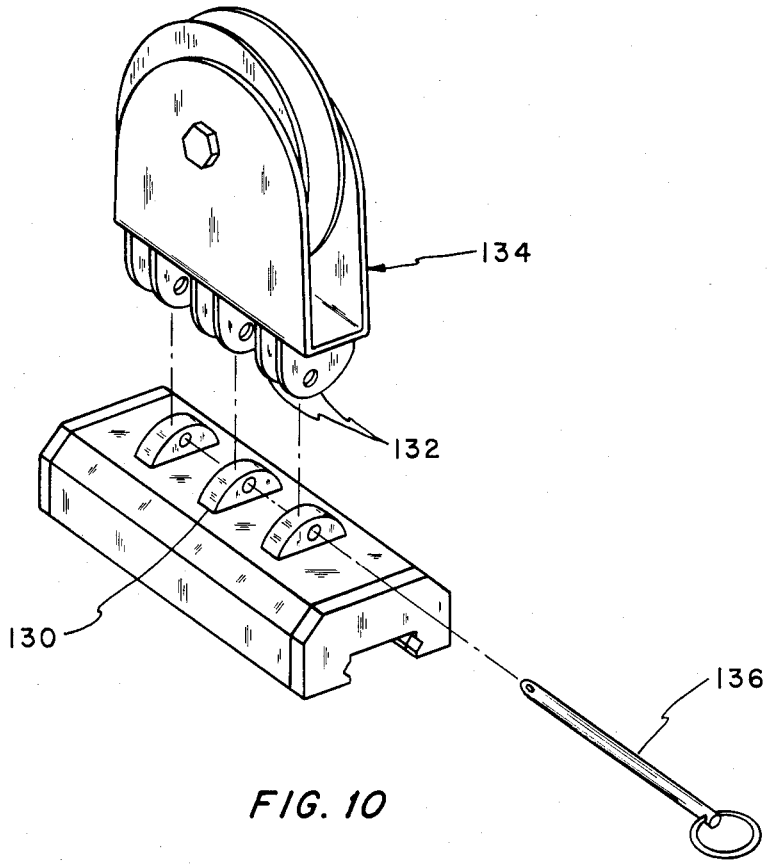

FIGS. 9 and 10 illustrate additional embodiments which use a single removable elongated pin to retain the block and car together. The pin is used to attach the block to the car at multiple locations along the length of the car.

As shown in FIG. 9, the bearing block 110 has a base wall 112 connecting the side walls 114 thereof. A plurality of spaced cars or tangs 116 are secured to and extend transversely and downwardly from the base wall. Each tang 116 is provided with an opening 118, and the openings are aligned along a common longitudinal axis.

The traveler car 120 has a plurality of spaced transverse slots 122 extending downwardly through the upper wall. The slots 122 correspond in number and spacing to the tangs 116, such that the tangs may be inserted into the slots. A longitudinal bore 124 is provided in the body of the car through one end thereof, said bore being coaxial with the tang apertures 118 when the tangs are inserted in the slots 122. An elongated pin 126 is inserted into the bore 124 and through the tang openings to retain the block assembly on the car. The pin 126 may be easily removed to allow detachment of the block assembly. Limited tilting of the block 110 to either side around pin 126 is accommodated by cutting the slots 122 wider than the tangs 116.

The embodiment of FIG. 10 is similar to FIG. 9 except that the car has a plurality of raised lugs 130 having aligned apertures. A pair of apertured tangs 132 from the block 134 embrace the lug 130, and the assembly is held together by a removable pin 136.

Figure 11:
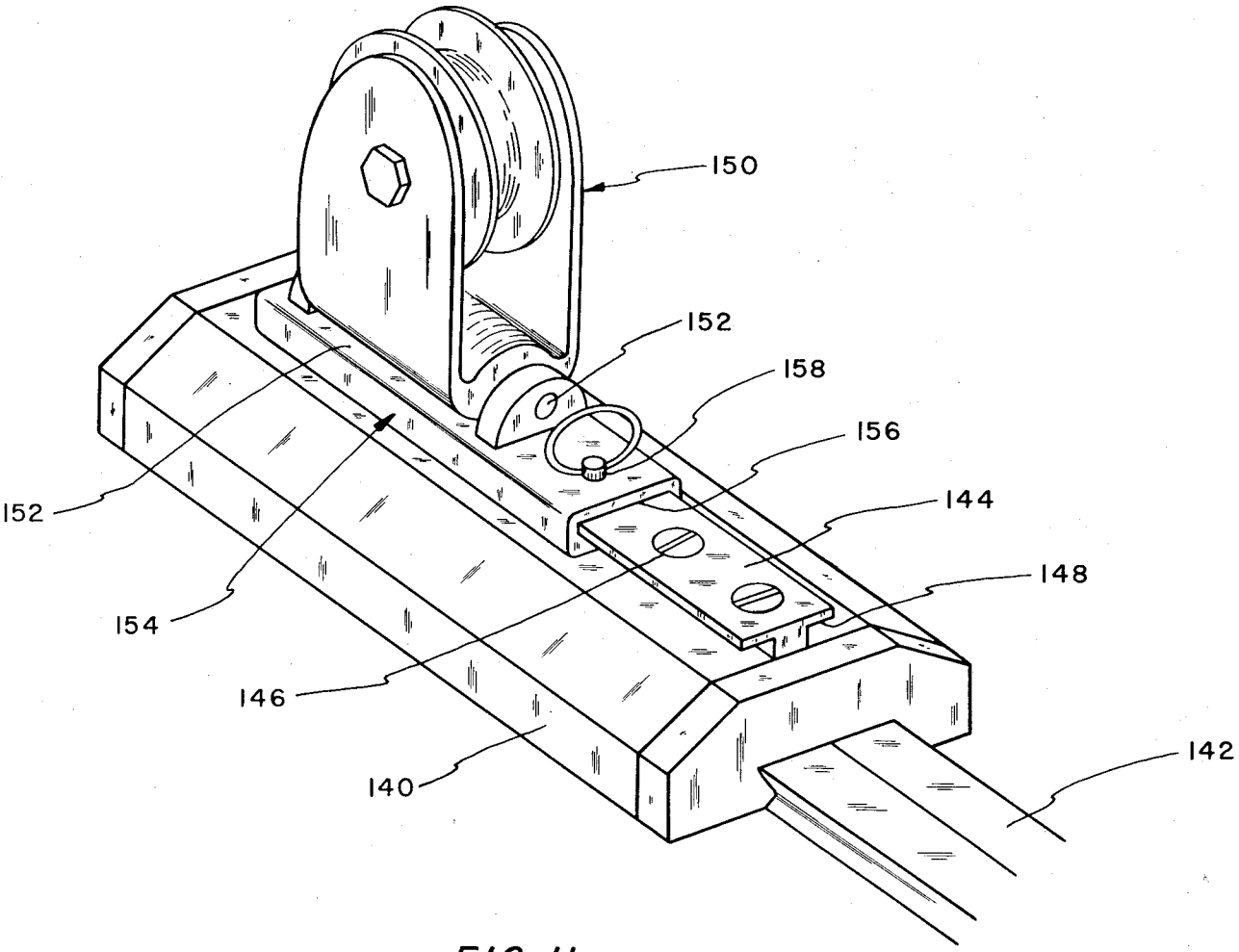
FIG. 11 is a vertical sectional view of an additional embodiment similar to that shown in FIG. 5.

Yet another embodiment of the present invention is shown in FIG. 11, in which a traveler car 140 is slidably mounted on a track 142 as aforesaid. In the present embodiment, an upstanding T-shaped member 144 is secured to the upper portion of the car 140 by means of bolts 146 or the like, with the groove 148 of the T-shaped member extending longitudinally. The pulley or block 150 is permanently connected by pivotal means 152 to the upper wall 152 of a slide or shoe 154 having a longitudinal T-shaped slot 156, which is complementary with the T-shaped member 114. It will be seen that this embodiment is the inverse of the version shown in FIG. 5. The block 150 and shoe 154 may be slid onto the T-shaped member 144 on the car 140 to enable installation and removal of the block from the car. This embodiment also preferably includes a spring loaded pin 158 to lock the block in an engaged position. Very obviously, many other versions are possible in which a projecting part from the top of the car slidably engages in a longitudinal slot in a shoe or slider attached to the block.

From the foregoing, it may be seen that the present invention provides a convenient and practical means for removably attaching a bearing block to a traveler car. The block assembly can be quickly removed and transferred to a car on a different track, thereby saving the expense of using multiple nonremovable blocks. The design of the systems as described herein cause loads on the block to be uniformly distributed to the traveler car, which minimizes twisting and binding of the car on the track and also minimizes potential failure due to concentrated stress.

We claim:

1. In conjuction with a sailboat having a deck, a foresail and a sheet for trimming the foresail, and a foresail lead block through which the sheet is passed, a lead car system comprising a plurality of spaced adjacent tracks secured to the deck of the boat, a traveler car slidably mounted on each of the tracks, a lead block mounted on one of said cars and comprising an upper rotatable sheave for receiving said sheet and a base for attachment to said traveler car, said base having a depending portion which interfits and mates with portions of each of said traveler cars in a complementary fashion to enable securement of said block to any of said cars, and means for releasably locking said base to said cars to enable transfer of said block to any of said cars, and means for releasably locking said base to said cars to enable transfer of said block from one car to another.

2. The lead car system of claim 1 wherein said base comprises a shoe and said cars each comprise a slot open at one longitudinal end for receiving the shoe.

3. The lead car system of claim 2 wherein the slot is open at the forward longitudinal end.

4. The lead car system of claim 2 wherein the slot has an upwardly open portion which is smaller than the size of the shoe.

5. The lead car system of claim 1 wherein said base comprises a plurality transverse tangs spaced longitudinally and having coaxial longitudinal openings therein, and a removable pin extending through said openings.

6. The lead car system of claim 5 wherein the body of each car has a plurality of slots therein receiving said tangs, and a longitudinal opening in said car for receiving said pin to releasably connect said block to said car.

7. The lead car system of claim 5 wherein the body of each car has a plurality of longitudinally space lugs, and a coaxial opening through said lugs for receiving said pin.

8. The lead car system of claim 1 wherein said base comprises a longitudinal slot and said cars each comprise a portion which slidably engages said slot.

9. The lead car system of claim 8 wherein said slot and said portion are T-shaped in cross section.

10. The lead car system of claim 1 wherein means are provided for adjustably moving each car in a forward and aft direction.

11. A foresail sheet control assembly for a sailboat comprising a track secured to the boat, a car slidably mounted on the track, and a bearing block means secured to the car for control of the sheet of a sail, the improvement wherein said bearing block means comprises a bearing block permanently attached to a shoe, and wherein said car comprises a slt complementary to said shoe having an open end for slidably receiving said shoe, and quick release means between the shoe and slot for releasably holding said shoe in an engaged position in said slot and permitting quick detachment of the shoe and block from the car.

12. The improvement of claim 11 wherein said shoe is wedge shaped and wherein said shoe and said slot comprise outwardly sloping side walls.

13. The improvement of claim 12 wherein said shoe and said slot have the shape of an inverted T in cross section.

14. The improvement of claim 11 wherein said shoe and said slot are rounded in configuration.

15. The improvement of claim 11 wherein said slot is open at one longitudinal end and has an abutment surface for said shoe at the other end.

16. The improvement of claim 11 wherein said slot is open at one side of the car for receiving the shoe.

17. The improvement of claim 11 wherein the means between the shoe and slot for releasably holding said shoe in an engaged position in said slot comprises a releasable pin extending between the shoe and the car.

18. The improvement of claim 11 comprising a second track secured to a deck a second car slidably mounted on the second track, said second car comprising a slot complementary to said shoe and having an open end for slidably receiving said shoe.

19. The improvement of claim 11 wherein said block is pivotally connected to said shoe.

20. The improvement of claim 19 wherein resilient means are provided between said shoe and said block for holding said block in an upright position.

21. The improvement of claim 20 wherein said resilient means comprises a section of elastomer tube.

* * * * *